US006324957B1

(12) United States Patent
Hendershot et al.

(10) Patent No.: US 6,324,957 B1
(45) Date of Patent: Dec. 4, 2001

(54) DETONATING CORD STOWAGE SYSTEM

(75) Inventors: John E. Hendershot, Dunkirk; John P. Murphy, Severna Park; John R. Luense, Accokeek, all of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/588,560

(22) Filed: Jun. 7, 2000

(51) Int. Cl.[7] ..... B64D 1/04
(52) U.S. Cl. ..... 89/1.13
(58) Field of Search ..... 89/1.13; 102/403

(56) References Cited

U.S. PATENT DOCUMENTS

| | | | | |
|---|---|---|---|---|
| 3,242,862 | * | 3/1966 | Stegbeck et al. | 89/1.13 |
| 3,724,319 | * | 4/1973 | Zabelka et al. | 89/1.13 |
| 3,949,673 | | 4/1976 | Lyerly . | |
| 4,232,606 | | 11/1980 | Yunan . | |
| 4,683,797 | | 8/1987 | Wittbrodt . | |
| 4,823,672 | | 4/1989 | Eidelman . | |
| 5,383,405 | | 1/1995 | Everest . | |
| 5,675,104 | | 10/1997 | Schorr et al. . | |
| 5,959,233 | * | 9/1999 | Garcia et al. | 89/1.13 |
| 5,960,732 | * | 10/1999 | Peterson | 114/244 |
| 6,182,573 | * | 2/2001 | Richards et al. | 102/275.12 |
| 6,205,903 | * | 3/2001 | Woodall et al. | 89/1.13 |
| 6,223,659 | * | 5/2001 | Garcia et al. | 102/504 |

OTHER PUBLICATIONS

Author—Unknown, "System Description" Article From Navy Website, WWW.NCSC.Navy.MIL/CSS/Projects/APOBS.

* cited by examiner

*Primary Examiner*—Charles T. Jordan
*Assistant Examiner*—Jordan Lofdahl
(74) *Attorney, Agent, or Firm*—Mark Homer

(57) ABSTRACT

A rocket-launched line charge apparatus for obstacle breaching includes at least two explosive charges connected by detonating cord. The detonating cord passes through a flexible tubing, and is bunched in a sinuous arrangement within the plastic tubing so as to store excess detonating cord. The detonating cord is attached to the two ends of the flexible tubing by cable ties. The explosive charges, the tubing and the detonating cord are enclosed in a fabric sock formed by overbraiding, the fabric sock being the strength member connecting the two explosive charges during deployment. The plastic tubing arrangement is applicable to storage of other cords in other systems involving tethered deployment of objects.

22 Claims, 2 Drawing Sheets

DETONATING CORD STOWAGE SYSTEM

BACKGROUND OF THE INVENTION

1. Field of the Invention

The present invention relates to the aerial deployment of objects, particularly the deployment of munitions, and more particularly to the deployment of line charges for obstacle breaching.

2. Description of the Related Art

Overcoming military obstacles such as wire obstacles and anti-personnel mines is of great importance during military operations. Over the years, systems involving explosive charges have been developed to clear minefields. More recently, rocket-deployed line charges have been developed for obstacle breaching. In most of these line-charge systems, explosive charges are connected by a strength member such as ropes, and a rocket motor at one end of the line charge drags the line charge aerially onto the obstacle. The explosive charges are then detonated to clear a path through the obstacle.

Examples of such obstacle breaching systems are seen in the following U.S. Patents. U.S. Pat. No. 4,683,797, to Wittbrodt, entitled LINE CHARGE DETONATION INTERLOCK ASSEMBLY, discloses a military system for clearing a path through a minefield, including a rocket launched flexible line and associated explosive blocks.

U.S. Pat. No. 4,823,672, to Eidelman, entitled APPARATUS AND METHOD FOR NEUTRALIZING MINEFIELDS, describes a rocket launched apparatus including strands of explosive charge detonated by explosive cord. The strands are rolled and covered by a plastic casing.

U.S. Pat. No. 5,675,104, to Schorr et al., entitled AERIAL DEPLOYMENT OF AN EXPLOSIVE ARRAY, describes an apparatus in which an array of charges are connected by strapping and detonation cord.

U.S. Pat. No. 5,959,233, to Garcia et al., entitled LINE CHARGE FASTENER AND DETONATING CORD GUIDE, describes deployable ammunition for clearing mine fields in which a detonating cord extends through bores of explosive charges. The detonating cord may slide through the bore to avoid strain failure during launch. A fabric sleeve encases the explosive charges and the detonating cord between the charges.

U.S. Pat. 5,960,732, to Peterson, entitled LINE CHARGE DEPLOYMENT APPARATUS, describes a fine charge deployable from a watercraft. The line charges are attached by a detonator cord/strength member.

One system which has already been deployed is the Anti-Personnel Obstacle Breaching System, APOBS MK7, Mod 1, which is described in document http://www.ncsc.navy.mil/CSS/Projects/apobs/apobs_paper/combo3.htm. This system includes a rocket motor and front fuze assembly, a front backpack assembly containing 60 fragmentation grenades spaced along a 25-m detonating cord and nylon rope line charge assembly, a rear backpack and rear fuze assembly containing 48 fragmentation grenades spaced along a 20-m detonating cord and nylon rope line charge assembly. Here the nylon ropes are the strength members.

The deployable line charges generally use detonating cord to detonate the individual charges, and an important consideration in the design of deployable line charges is the stress to the detonating cord during deployment. The tensile strength during deployment is generally carried by a strength member connecting the explosive charges so that the detonating cord is not stressed, and stress to the detonating cord can be avoided by providing excess (slack) detonating cord to allow for lengthening of the strength member during deployment.

Recently, an improvement to the APOBS system has been proposed in which the nylon rope strength member assembly is replaced with an overbraided fabric sleeve. Braiding is a fiber placement technique which results in a tubular braided fabric with unique fiber architecture as opposed to other fabric forming methods such as weaving. In particular, the process of overbraiding, that is, forming the braid around the object to be covered, has particular advantages. Among these advantages are the elimination of bands used to clamp the nylon ropes to the explosive charges, better protection of the detonating cord from damage upon landing, better tensile performance of the strength member and, concomitantly, better flight characteristics.

However, during the overbraiding of a line charge of explosives and detonating cord, it is difficult to provide excess detonating cord between the individual explosive charges while keeping the proper separation between the explosive charges.

Moreover, it is desirable to make sure that the excess detonating cord lies flat and is neatly stowed in the braided sleeve. Eventually, the braided sleeve is folded as the line charge is packed in the backpack from which the line charge is deployed, and this folding is best performed if the sleeve may be folded flatly.

Therefore, based on our reading of the art, we have decided that what is needed is an improved arrangement for providing excess detonating cord in a deployable device. Such a system by should allow for overbraiding but not interfere with the providing of slack in the detonating cord.

SUMMARY OF THE INVENTION

It is therefore an object of the present invention to provide an improved obstacle-breaching apparatus.

A further object of the invention is to provide an improved obstacle-breaching apparatus having an overbraided fabric sock as the strength member.

A yet further object of the invention is to allow for easier manufacture of an obstacle-breaching apparatus having an overbraided fabric sock.

A still further object of the invention is to provide improved deployable apparatus having tethered objects.

These and additional objects of the invention are achieved in the present invention. In one embodiment, the present invention is a cord-stowage device for a deployable tether between two objects, and includes a cord connecting the two objects, the cord passing through a tubing made of a flexible material. The cord is bunched in sinuous fashion within the tubing so as to store excess cord. The cord is fastened to the tubing near each end of the tubing. The cord and tubing are within a fabric sock which forms a strength member tethering the two objects.

In this embodiment, the fabric sock may be overbraided over the cord and tubing. The cord is attached to the tubing such that the cord detaches from the tubing upon the tensile load of deployment which is borne by the fabric sock. The tubing may be made of plastic, and may be fastened to the cord by fasteners such as cable ties.

A particular embodiment of the invention is a line-charge apparatus for obstacle breaching. In the line-charge apparatus, a detonating cord connects two grenades. The detonating cord passes through a tubing made of a flexible material. The detonating cord is bunched in sinuous fashion within the tubing so as to store excess cord. The cord is fastened to the tubing near each end of the tubing. The cord and tubing are within a fabric sock which forms a strength member tethering the two grenades, and the fabric sock may be overbraided over the grenades, the tubing and the detonating cord.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
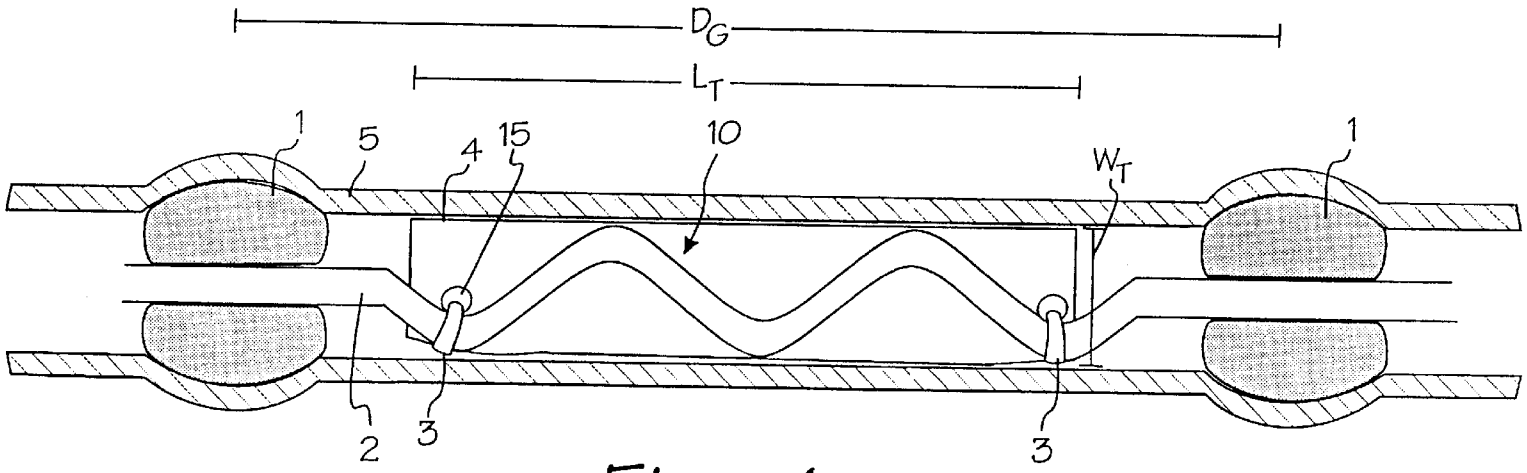
FIG. 1 illustrates a transverse cross-section of one embodiment of the present invention.

Turning now to the drawings, the basic apparatus of the invention is seen in FIG. 1. In FIG. 1,the apparatus is illustrated as part of a deployable line charge apparatus. In FIG. 1, the deployable line charge apparatus includes explosive charges 1 and detonating cord 2 passing through the explosive charges for detonating the explosive charges. Surrounding explosive charges 1 is fabric sleeve 5 which serves as a strength member for connecting the line charges.

Within fabric sleeve 5 is tubing 4, and detonating cord 2 passes through tubing 4. The detonating cord is firmly attached to tubing 4 at both ends of tubing 4 by fasteners 3. The length of detonating cord between the fasteners 3 is greater than the length of tubing 4. That is, there is an excess length of detonating cord inside the tubing. This excess length is in sinuous arrangement 10 within the tubing. Although other arrangements of the excess length are possible, for example coiling, sinuous arrangement 10 allows for fabric sleeve 5, tubing 4 and detonating cord 2 to lie flat, which facilitates packaging of the overall device.

The fabric sleeve 5 shown in FIG. 1 is an overbraided fabric sleeve. Fabric sleeve 5 may be a different form of sleeve, such as a sleeve which is sewn from a panel of fabric around the assembly. Other strength members known in the art, such as nylon ropes, may also be used in place of fabric sleeve 5. The apparatus having detonating cord 2, tubing 4 and fasteners 3 is particularly useful with an overbraided fabric sleeve, however, due to the manufacturing process of the overbraided fabric sleeve.

Figure 2:
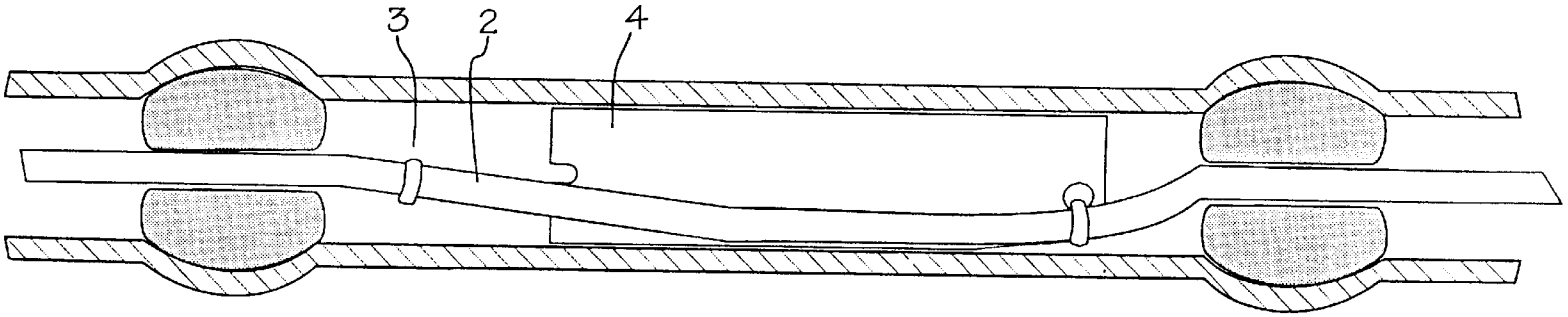
FIG. 2 illustrates a transverse cross-section of the embodiment of the invention shown in FIG. 1 during deployment of the invention.

In the embodiment shown in FIG. 1, fastener 3 is a cable tie passing through holes 15 which as penetrate opposite faces of the tubing on one end of the tubing and which clasps a portion of tubing 4 against detonator cord 2. Two fasteners 3 are provided, one on each end on the tubing. Many fastening arrangements known in the art, other than cable ties, maybe used for fastener 3. The only limitation on fastener 3 is that detonating cord 2 somehow release from tubing 4 as the distance between explosive charges 1 increases during deployment. During deployment, fabric sleeve 5 stretches and thus tension is placed on the tubing from the tension of the detonating cord on fasteners 3. FIG. 2 illustrates one possible mode of release of the fastener during deployment, in which one of the fasteners 3 has torn through the end of tubing 4 where the fastener was attached, for example tearing through hole 15. It is alternatively possible to attach fastener 3 loosely enough so that the detonating cord slips through the fastener.

Thus, fastener 3 may alternatively be any of a variety of attachment devices, such as a clamp, string, rubber band, or adhesive. The attachment device may be placed outside or inside tubing 4, and the holes 15 shown in FIG. 1 represent only one embodiment of the invention and are not necessary.

Tubing 4 may be any tubing with sufficient tensile strength to maintain the sinuous shape of the detonating cord during processing, packaging and handling. Generally, tubing 4 will be a thin-walled, flexible plastic tubing. A lay-flat tubing which is already creased may be used, or the tubing may be round. Flexibility of the tubing, particularly to allow flattening, is desirable, as the packaging of the line charge apparatus may be achieved by flattening and folding the fabric sleeve between the explosive charges. Most plastics are suitable for the plastic tubing, including polyethylene, polypropylene, polyester such as Mylar®, polytetrafluoroethylene such as Teflon®, polyamide such as nylon, etc.

The apparatus of the present invention has been illustrated with respect to providing excess detonating cord, to allow for slack in the detonating cord between two explosive charges in a line charge array. A line charge array would typically have a large number of explosive charges connected by detonating cord and a strength member such as overbraided fabric sleeving. The apparatus as shown in FIG. 1 could be used between each pair explosive charges, or it could be used only between only those charges where slack in the detonating cord is needed.

For example, in one embodiment of the invention, an obstacle breaching system includes a rocket motor and front fuze assembly, a front backpack assembly containing 60 fragmentation grenades spaced along a 25-m detonating cord and overbraided fabric sleeve line charge assembly, a rear backpack and rear fuze assembly containing 48 fragmentation grenades spaced along a 20-m detonating cord and fabric sleeve line charge assembly. This is a similar arrangement to the APOBS MK 7 Mod 1, except for the use of overbraided fabric sleeve as the strength member instead of nylon ropes. In this embodiment, the arrangement of tubing 4 and fasteners 3 stowing the detonating cord in sinuous arrangement 10 is used between the sequential pairs of the first ten grenades and last ten grenades of each of the front and rear backpack assemblies. In this embodiment, the center-to-center spacing between the grenades, $D_g$ as shown in FIG. 1, is 16-⅜". Tubing 4 has length $L_t$ of approximately 13 to 14", and flattens to width $W_t$ of approximately 1-½". The excess length of detonating cord of approximately 2-⅝" is stowed in sinuous region 10 inside the tubing.

This embodiment of the invention as an obstacle-breaching system is designed to be deployed by a rocket motor from two storage in two backpacks. The device of the present invention can more generally be used with a variety of deployment systems, such as air cannon or other cannon, aerial drop, etc.

In manufacturing the obstacle breaching system of this embodiment, the grenades (explosive charges) are typically laid on a table or trough, and the sleeves of plastic tubing 4 laid out appropriately between the grenades. The detonating cord is then strung through the grenades and tubing and is attached to the grenades at appropriate positions on the cord. The excess detonating cord is bunched within tubing 4 and fastened with fasteners 3. The assembly is then fed linearly through a braiding machine until the entire line charge is properly overbraided.

Figure 3:
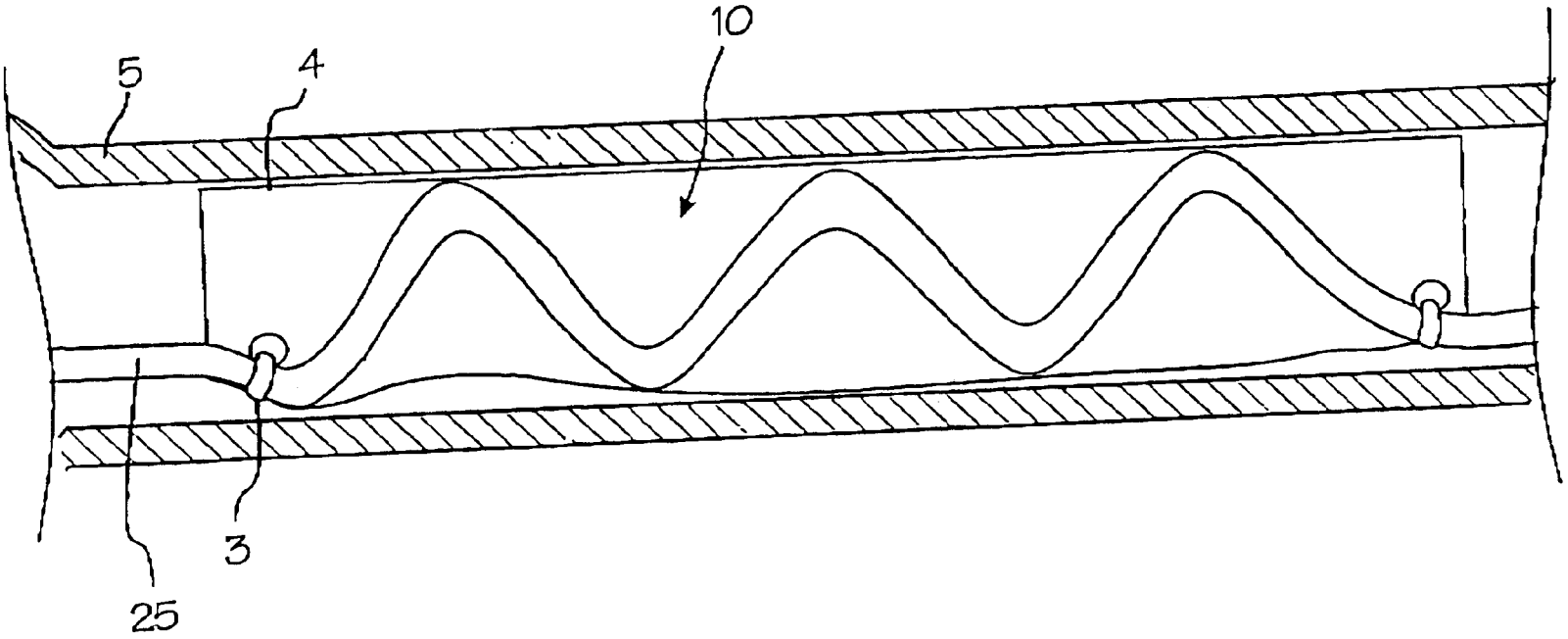
FIG. 3 illustrates another embodiment of the present invention.

The stowage system of the present invention may be used more generally in any apparatus involving one-time deployment of a tension-sensitive cord-shaped member which must be protected from tensile shock. For example, in FIG. 3, the stowage system is shown without illustrating the particular objects connected by fabric sleeve 5. Here, cord 25 could be a fiber-optic cable, electrical cable, pneumatic or hydraulic line, etc., connecting any two objects (not shown) in a deployable system. The stowage system of FIG. 3 could thus be used in any apparatus requiring deployment under tensile shock such as from rocket or cannon launch, towing or from parachute deployment. Possible applications involve deployment of robots, sensors or communication equipment or other remote equipment connected to a stress member tether. For example, one of the objects might be a robot and the other object might be a control station for the robot. The stowage system is particularly useful when the stress member is an overbraid around cord 25, due to the manufacturing requirements of overbraiding, as noted above.

It should be readily understood that many modifications and variations of the present invention are possible, and further alternative embodiments will be apparent to those skilled in the art. Such modifications include changes in shape, size, and arrangement of parts and substitution of materials. Thus, it is to be understood that modifications can be made to the foregoing description without departing from the true scope of the invention.

What is claimed is:

1. A cord-stowage device for a deployable tether between two objects, said cord stowage device comprising:

a tubing, located between the two objects, having two ends, said tubing being made of flexible material;

a cord connecting the two objects, a portion of said cord passing through said tubing, the length of said portion of the cord being greater than the length of said tubing and said portion of the cord being arranged in sinuous fashion within said tubing;

a first fastener attaching the cord to said tubing near one of said two ends of the tubing;

a second fastener attaching the cord to said tubing near the second of said two ends of the tubing;

a strength member connecting the two objects, said strength member being a fabric sock formed over the tubing, the cord and the first and second fasteners.

2. The cord-stowage device of claim 1, said fabric sock being formed by overbraiding the tubing, the cord and the first and second fasteners.

3. The cord-stowage device of claim 1, said flexible material being a plastic.

4. The cord-stowage device of claim 1, said tubing being a lay-flat sleeve.

5. The cord-stowage device of claim 1, said first fastener being a cable tie.

6. The cord-stowage device of claim 5, said cable tie being fastened around a portion of the tubing and through a hole penetrating two faces of the tubing.

7. The cord-stowage device of claim 1, said cord being a detonating cord.

8. The cord-stowage device of claim 1, said cord being a communications cable.

9. A line-charge apparatus for obstacle breaching, comprising:

a first explosive charge;

a second explosive charge separated from said first explosive charge;

a detonating cord connecting said first and second explosive charges, for detonating the explosive charges;

a tubing formed of a flexible material and having two ends, a portion of said detonating cord passing through said tubing, the length of said portion of the detonating cord being greater than the length of said tubing, and said portion of the detonating cord being arranged in sinuous fashion within said tubing;

a first fastener attaching the detonating cord to said tubing near one of said two ends of the tubing;

a second fastener attaching the detonating cord to said tubing near the second of said two ends of the tubing;

a strength member connecting the two explosive charges, said strength member being a fabric sock formed over said explosive charges, said tubing, said detonating cord and said first and second fasteners.

10. The line-charge apparatus of claim 9, said fabric sock being formed by overbraiding the explosive charges, the tubing, the detonating cord and the first and second fasteners.

11. The line charge apparatus of claim 9, further comprising:

a plurality of additional explosive charges, said additional explosive charges being spaced along a portion of said detonating cord on a side of said first explosive charge away from said second explosive charge, and said strength member being a continuous overbraiding further extending over said additional explosive charges and the detonating cord between the additional explosive charges.

12. The line charge apparatus of claim 11, further comprising:

a rocket motor attached to one of said explosive charges, for aerially deploying the line charge.

13. The line charge apparatus of claim 12, further comprising:

the line charge being divided into a front and a rear section;

said front section having a total of 60 explosive charges, there being one of said tubing between each sequential pair of the first ten and last ten of said 60 explosive charges of the front section; and said rear section having a total of 48 explosive charges, there being one of said tubing between each sequential pair of the first ten and last ten of said 48 explosive charges of the rear section.

14. The line charge apparatus of claim 9, said flexible material being a plastic.

15. The line charge apparatus of claim 9, said tubing being a lay-flat sleeve.

16. The line charge apparatus of claim 9, said first fastener being a cable tie.

17. The line charge apparatus of claim 16, said cable tie being fastened around a portion of the tubing and through a hole penetrating two faces of the tubing.

18. The line charge apparatus of claim 14, said flexible material being polyethylene.

19. The line charge apparatus of claim 9, said length of said portion of the detonating cord being greater than the length of said tubing by approximately 2-⅝".

20. The line charge apparatus of claim 9, said first fastener being attached so as to release the detonating cord from the tubing under the tension of deployment of the line charge apparatus.

21. A method of fabricating a line-charge apparatus for obstacle breaching, comprising the steps of:

arranging explosive charges separated from one another on a surface;

laying out a sleeve of tubing between a pair of the explosive charges; then stringing detonating cord between the explosive charges and through the sleeve of tubing;

attaching the detonating cord to the explosive charges at predetermined positions on the detonating cord;

bunching an excess of detonating cord within the sleeve to form a sinuous arrangement of cord, and fastening the detonating cord to the sleeve near each end of the sleeve; and then sequentially feeding the strung explosive charges through a braiding machine to overbraid the explosive charges, the sleeve and the detonating cord in a continuous fabric sock.

22. The method of claim 21, said step of fastening the detonating cord to the sleeve further comprising:

passing a cable tie through holes in the faces of the sleeve and around a region of the sleeve wrapping the detonating cord.

* * * * *